United States Patent [19]

Skakas

[11] Patent Number: 4,934,997

[45] Date of Patent: Jun. 19, 1990

[54] THERAPEUTIC INFANT BED

[76] Inventor: Pauline V. Skakas, 1620 Lasuen, Santa Barbara, Calif. 93103

[21] Appl. No.: 168,597

[22] Filed: Mar. 4, 1988

Related U.S. Application Data

[63] Continuation of Ser. No. 917,408, Oct. 10, 1986, abandoned, which is a continuation-in-part of Ser. No. 572,670, Jan. 20, 1984, abandoned, which is a continuation-in-part of Ser. No. 371,990, Apr. 26, 1982, abandoned.

[51] Int. Cl.[5] ..... A47D 9/02

[52] U.S. Cl. ..... 600/26; 5/101; 5/107; 5/108; 5/170

[58] Field of Search ..... 600/26–28, 600/21–22; 5/101, 104, 105, 107, 108, 109, 120, 122, 465, 485; 128/872, 873

[56] References Cited

U.S. PATENT DOCUMENTS

| | | | |
|---|---|---|---|
| 348,809 | 9/1886 | Wicker | 5/105 |
| 2,096,913 | 10/1937 | Munro | 5/494 |
| 2,127,710 | 8/1938 | Baher | 5/186 R |
| 2,389,362 | 11/1945 | Harper | 4/572 |
| 2,916,745 | 12/1959 | Lesl et al. | 5/109 |
| 3,412,410 | 11/1968 | Denfeld | 5/485 |
| 3,419,923 | 1/1969 | Cownn | 128/1 L X |
| 3,659,297 | 5/1972 | Schutz | 5/465 |
| 3,849,812 | 11/1974 | Walsh | 5/105 X |
| 4,028,753 | 6/1977 | Rios | 5/108 |
| 4,064,576 | 12/1977 | Threatt | 5/485 |

*Primary Examiner*—Kyle L. Howell
*Assistant Examiner*—J. P. Lacyk
*Attorney, Agent, or Firm*—Donald A. Streck

[57] ABSTRACT

A therapeutic infant bed primarily intended for hospital use in the treatment and prevention of infant apnea. The bed comprises a hammock-forming sheet of material having one surface thereof covered with a soft tactile material. The hammock-forming sheet of material includes means for attaching a sonic device for generating audible sounds and mechanical vibrational impulses simulating a human heartbeat thereto and for causing the audible sounds and mechanical vibrational impulses to be transmitted through the sheet and the support structure to an infant disposed in the bed. A support structure is provided which has raised, spaced end members defining an open space therebetween. The hammock-forming sheet of material is horizontally suspended between the end members with the one surface facing up between the end members, within the open space, and above a surface upon which the support structure is sitting to form a hammock having spaced head and foot ends and spaced sides between which an infant can be placed. Rocking means are operably attached to the support structure for supporting the support structure on a planar surface and for slowly and gently rocking the support structure primarily only in a horizontal plane. In the preferred embodiment, the rocking means comprises a plurality of spring suspension members self activated by the infant's movements and disposed under the support structure.

4 Claims, 3 Drawing Sheets

THERAPEUTIC INFANT BED

CROSS-REFERENCE TO RELATED APPLICATIONS

This application is a continuation of application Ser. No. 917,408, filed 10 Oct. 1986, now abandoned, which, is a continuation-in-part of application Ser. No. 572,670 filed 20 Jan. 1984, abandoned which, in turn, was a continuation-in-part of a co-pending application of Pauline Shakas, titled Infant Transitional Sensory System, Ser. No. 371,990, filed 26 Apr. 1982, abandoned.

BACKGROUND OF THE INVENTION

This invention relates to a therapeutic infant bed for assisting the infant in achieving a smooth transition from the womb while reducing the trauma of the birth experience and contributing to the infant's adaptation to a totally new environment. More particularly, it is related to an therapeutic infant hospital bed unit adapted to prevent infant apnea in premature infants which comprises a hammock-forming sheet of material having one soft tactile surface; a support structure adapted to sit on a planar surface and having raised, spaced end members defining an open space therebetween; means for horizontally suspending the hammock-forming sheet of material with the one surface facing up between the end members within the open space and above a surface upon which the support structure is sitting to form a hammock having spaced head and foot ends and spaced sides between which an infant can be placed; and rocking means operably attached to the support structure for supporting the support structure on a planar surface and for rocking the support structure along a line between the head and the foot ends.

In recent years, various psychological studies have shown that the environment and treatment of an infant in the days and months following birth can and do have a major psychological effect in later years of life. In the womb, a fetus has an intimate symbiotic relationship with the mother; it generally becomes increasingly aware of various sensory stimuli as it develops, but particularly of sounds, touch, movement and its enveloping space. This enriched environment in the womb provides and offers the fetus both a feeling of security and considerable tactile kinesthetic stimulation.

At birth, the rich intrauterine environment is suddenly replaced with a whole new world of sensation. The gamut of stimuli given the fetus before birth suddenly stops. Recent investigations indicate that kinesthetic stimuli such as touching, movement, sound, and definition of space, stimuli provided by rocking and cuddling, result in impulses in the infant's nervous system that are directed to the cerebellum to stimulate its development, a process that goes on for at least the first two years of a child's life. Since the cerebellum appears to be the only part of the brain in which brain cell multiplication continues long after birth, this cerebellar stimulation has been shown to be of profound importance in the development of the whole person. Kinesthetic stimulation of the infant, therefore, well may be of primary importance; yet, modern baby care practices often prevent just such stimulation. Indeed, many of the products available to parents today are designed to free parents from activities which would provide kinesthetic stimulation for the infant.

As described in my above-referenced, co-pending patent applications, the profound influence of the primal sound and vibration of the heartbeat has been proven to enhance the infant's entire physical and emotional development. Further described therein is the fact that tactile stimulation appears to initiate all innate infant reflexes. Touch is the infant's number one teacher. Not only does it help the infant develop emotional security; but, it actually appears to also assist the body in development of the brain and nervous system. For this reason, actions such as holding the infant, massaging the infant, and providing the infant with different textures to touch are vitally important. Tactile stimulation also seems to have a calming effect on the infant and to assist the infant in organizing its sensory systems, called sensory integration. My prior applications also discuss the fact that the proper development of the motor, joint and muscle system, as well as the vestibular system, requires space identification and movement on the part of the infant. Providing the infant with an environment which resists, but yields, to its own initiated movement, allows the infant to be involved in his own muscular and skeletal system development.

An additional consideration in the overall area of concern is the incidence of infant apnea with premature infants while in the hospital environment. Particularly in problem situations such as those where the mother consumed drugs during her pregnancy, there is no presently available non-drug oriented calming technique to sooth the infant.

The normal hospital bassinette or isolette provided for an infant in the days following birth offer little if any of the necessary and therapeutic stimuli discussed above—and do nothing beneficial with respect to the prevention and relief of infant apnea, and similar problems, mentioned above. For example, the typical hospital bassinette is simply a basin of clear plastic holding a firm mattress pad. A newborn infant, wrapped in a blanket, is placed on that pad, the clear sides of the bassinette offering attending nurses an unobstructed view of the infant. This arrangement, while beneficial for infant observation, is obviously far different from the rich intrauterine environment described above and creates an enormous sensory deprivation for the infant. A similar problem exists in the case of the apnea-prone premature infant which is, typically, laid on the firm mattress of the isolette without the benefit of the cuddling or wrapping blanket, because of the temperature-controlled environment therein.

Wherefore, it is an object of the present invention to provide an infant hospital bed unit to be employed immediately following birth to provide an enriched environment directed to the infant's need for continuing positive input into his delicate sensory system.

It is a further object of the present invention to provide an infant hospital bed unit having therapeutic benefits to, primarily, premature infants who are apnea-prone.

SUMMARY OF THE INVENTION

The foregoing objects have been achieved by the therapeutic infant bed for use in the treatment and prevention of infant apnea of the present invention comprising, a hammock-forming sheet of material having one surface thereof covered with a soft tactile material, the hammock-forming sheet of material including means for attaching a sonic device for generating audible sounds and mechanical vibrational impulses simulating a human hearbeat thereto and for causing the audible sounds and mechanical vibrational impulses to be transmitted through the sheet and the support structure to an infant disposed in the bed; a support structure adapted to sit on a planar surface and having raised, spaced end members defining a open space therebetween; means for horizontally suspending the hammock-forming sheet of material with the one surface facing up between the end members within the open space and above a surface upon which the support structure is sitting to form a hammock having spaced head and foot ends and spaced sides between which an infant can be placed; and, rocking means operably attached to the support structure for supporting the support structure on a planar surface and for rocking the support structure along a line between the head and the foot ends, the rocking means comprising a plurality of spring suspension members disposed under the support structure, the spring suspension members being adapted to resist compression and lateral forces and to easily respond to head end to foot end forces.

In the preferred embodiment, the hammock-forming sheet of material has a pair of side sheets of material attached thereto along the respective ones of the space sides, the side sheets having an inner surface facing the one surface of the hammock-forming sheet which is covered with a soft tactile material, the side sheets further including means for fastening them together to form a hammock pouch in combination with the hammock-forming sheet into which an infant can be placed with its head at the head end and its feet at the foot end.

Further in the preferred embodiment, the hammock-forming sheet of material comprises a composite sheet of material having an inner pile surface and an outer reinforcing fabric adapted to resiliently deform to form an area for receiving and cuddling an infant disposed therein.

DESCRIPTION OF THE PREFERRED AND ALTERNATE EMBODIMENTS

The therapeutic infant bed of the present invention is both simple and effective. Moreover, it has demonstrated in actual hospital testing its ability to provide both an enhanced environment for an infant in the days immediately following birth as well as therapeutic and calming effects in the case of apnea-prone infants such as those discussed above as in the case where the mother took drugs during pregnancy. More specifically, recent hospital testing of the therapeutic infant bed of the present invention in its preferred embodiment, as will hereinafter be described in greater detail, conclusively demonstrated that infants who were totally uncalmable without the use of drugs because of parent involvement with drugs during pregnancy were immediately calmed and placed in a relaxed and comfortably sleeping state through the use of the present invention totally without the use of accompanying drugs. As noted by the hospital staff, the present invention is the only thing known to them which can provide such calming of apnea-prone infants without the use of drugs.

Figure 1:
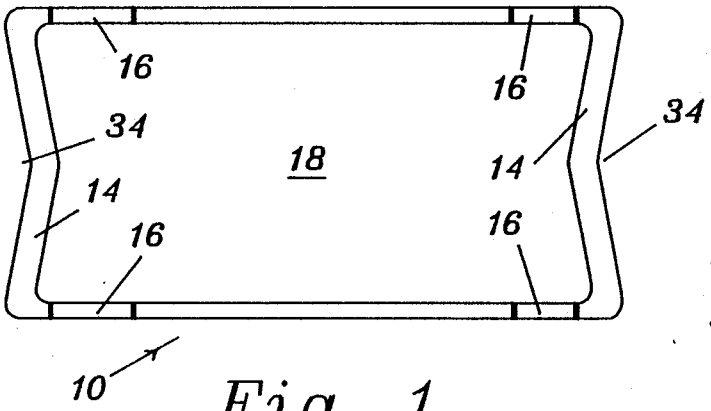
FIG. 1 is a plan view of the supporting structure of the present invention.
Figure 2:
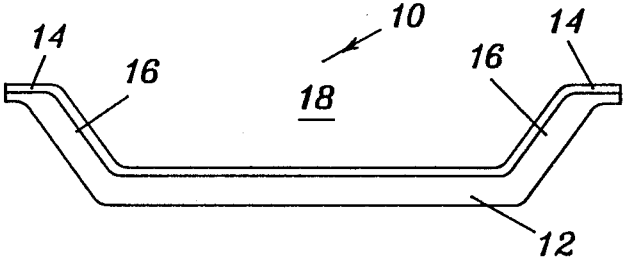
FIG. 2 is a side view of the supporting structure of FIG. 1.
Figure 3:
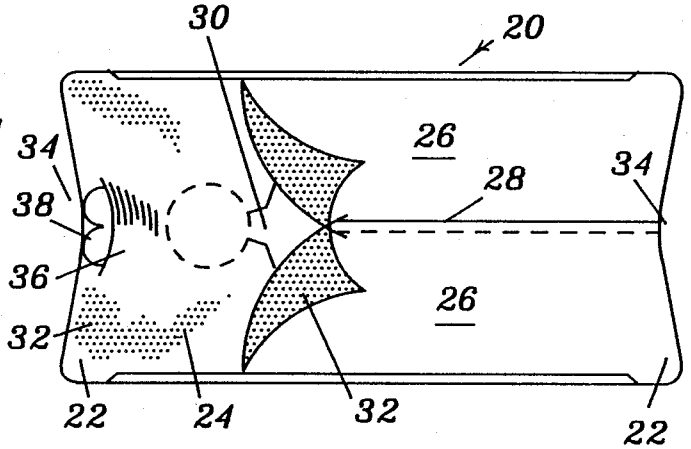
FIG. 3 is a plan view of the present invention showing the pouch-forming member attached to the supporting structure.
Figure 4:
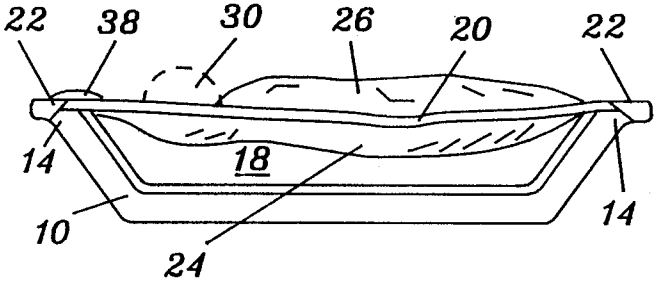
FIG. 4 is a side view of the assembled components of FIG. 3.

The basic portion of the present invention is the supporting structure, generally indicated as 10, of FIGS. 1 and 2. In the preferred embodiment, supporting structure 10 is of lightweight plastic and comprises a pair of parallel base members 12 supporting a pair of spaced horizontal wing members 14 on support arms 16. As can be seen, the wing members 14 are raised above the base members 12, therefor defining the opposite ends of an open space 18. As shown in FIGS. 3 and 4, a pouch-forming member 20 is suspended from the wing members 14 within space 18 by means of pockets 22 formed in the ends thereof. Pouch forming member 20 in its preferred embodiment is, effectively, a hammock sheet consisting of a central portion 24 and two side portions 26 that fold over the central portion and may be attached together, as by a zipper 28, along the adjacent inner margins of the side portions 26 to form, with the central portion 24, a pocket for receiving an infant 30.

To provide the tactile environment which forms one of the major elements of the present invention, the inner surface of the pouch-forming member 20 is preferably formed of a fur-like dense pile material 32, such as soft terrycloth, to provide the infant with tactile stimulation. Preferably, the pile material 22 is bonded to or otherwise supported and reinforced by an outer material which may, for example, be nylon netting. While the resulting composite sheet forming the central portion 24 will give and deform somewhat to receive the infant 30 as well as in response to the infant's movements, it causes the infant to be held in a reasonably snug fashion and also assists gradual relaxation of the sheet to deepen and deform to the desired pouch-like shape. The pockets 22 are formed at each end portion or margin of the central portion 24, such as by sewing an appropriately shaped hem in the nylon netting. As described above, the pockets 22 receive the outwardly extending wing members 14 formed as part of the supporting structure 10. If desired, the pockets 22 and wing members 14 can be provided with an indented center portion, as at 34, to permit a nurse or other attendant of the infant to pass their fingers between these indented portions and the inner side of a bassinette, or the like, to easily place the infant bed of the present invention into and remove it from a bassinette, or the like. Additionally, if desired, pockets 22 may include tabs of VELCRO touch fastener materials (not shown) which cooperate with mating touch fastener tabs (also not shown) on the underside of the wing members 14 to positively lock the pouch-forming member 20 to the supporting structure 10. In another possible embodiment of the present invention (not shown), the pouch-forming member 20 may have end portions having touch fastener material strips extending along outer margins, the outer margins being folded over the wing members 14 and interlocked with cooperating touch fastener strips on the underside of the wings to hold the pouch-forming member 20 to the supporting structure 10.

By any of the above-described arrangements, or other possible arrangements not forming a point of novelty hereof, the pouch forming member 20 is suspended by the supporting structure 10 above the mattress pad, or the like, upon which the supporting structure 10 is placed and is free to assume a position conforming to the infant 30 by deforming in the manner described above. It provides flexible side areas that conform and deform to a variety of shapes, permitting an infant held in the pouch-forming member 20 to move, exercise, and define its surrounding space. Moreover, the pouch-forming member 20 is readily removable from the frame for laundering and is constructed of materials which permit it to be sterilized.

The second aspect of the generally three-part therapeutic package provided by the present invention is that of vibratory stimulation. For this purpose, the pouch-forming member 20 includes a pocket 36 therein into which is placed a battery-operated sonic device or generator 38 which generates both audible and vibratory impulses into the pouch-forming member 20 and supporting structure 10, from whence they are conducted into the surrounding environment of the infant 30 to be sensed by the infant as a reasonable simulation of the human heartbeat, thereby duplicating to a significant extent the dominant, normal and soothing sound patterns received by the infant during its period of utero-gestation. The details of the preferred sonic generator 38 are provided in detail in my above-referenced patent application Ser. No. 371,990 and, therefore, the device will not be described in greater detail herein.

While the aspects of the present invention hereinbefore described provide useful, beneficial, and healthful stimulation and environmental considerations for the normal infant, the apnea-prone premature infant requiring therapeutic considerations requires the third factor provided by the present invention in order to achieve the full therapeutic and calming effects provided thereby. This aspect of the present invention is based on the discovery, following extensive testing, that, aside from the requirement for rythmic sound vibration and the above-described environmental considerations provided by the present invention, the apnea-prone infant has a high requirement for movement. The normal baby has been rocked by his mother's movements until full-term development. The premature infant, on the other hand, has been robbed of this developmental influence with profound implications. Lack of movement results in a severe lack of development in the vestibular and gravity sensory systems. Moreover, it appears from testing that the seat of calming in the apnea-prone infant also resides to a large part in these same vestibular and gravity sensor areas of the body. For this reason, the present invention has been provided with a rockable base which, preferably, rocks the infant in the correct head-to-foot movement to provide the desired calming results. That is, a preferred beneficial effect is accomplished not by rocking from side-to-side in the usual manner of cradles, and the like, or by a bouncing or swinging movement, but rather, through the use of a gentle and generally horizontal head-to-foot, back and forth movement.

Figure 6:
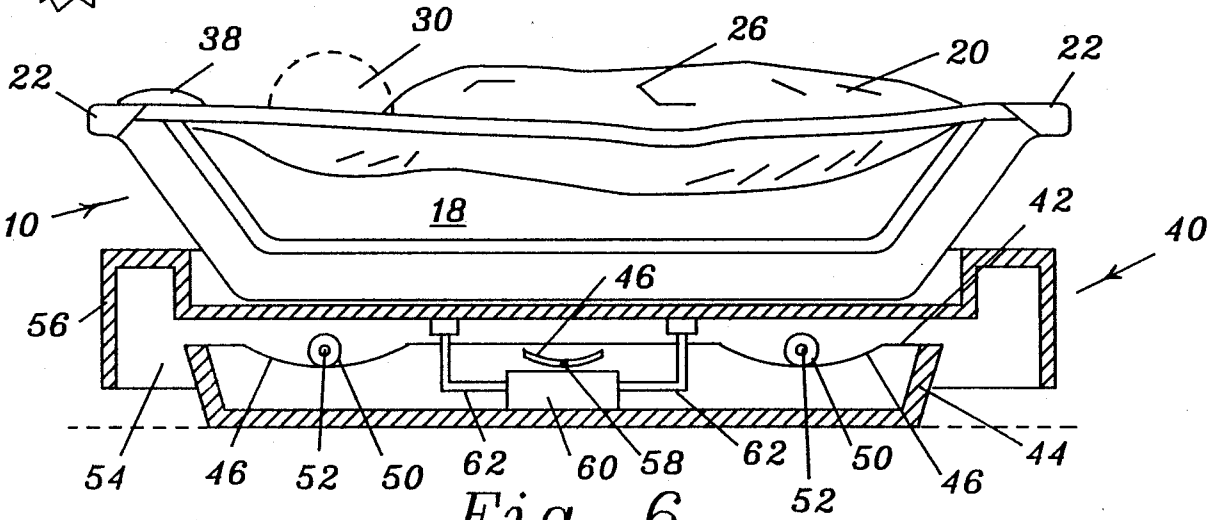
FIG. 6 is a cutaway side view of rocking apparatus of the present invention according to a first embodiment thereof.

In one embodiment as shown in FIG. 6, this rocking motion is provided by the rockable base generally indicated as 40 therein. In base 40, the longitudinal side edges 42 of the bottom portion 44 each include two arcuate portions 46 as well as a centrally-located arcuate slot 48. Rollers 50 are appropriately supported on shafts 52 attached to the sides 54 of top portion 56 upon which the supporting structure 10 is placed. Also, pin 58 attached to the sides 54 of top portion 56 extends through slot 48 and prevents the top portion from being lifted from the bottom portion 44, yet permits movement of the top portion back and forth relative to the bottom portion 44 with rollers 50 rolling on the arcuate portions 46 while the pin 58 moves in the arcuate slot 48.

Preferably, the arcuate portions 46 are shaped to centrally locate portion 56 relative to portion 44 when at rest, yet permit easy movement of the two portions relative to one another for some distance, then increasing resistance to further movement. This is achieved by providing each arcuate slot 48 with a central area that is slightly curved (or even flat), the lowest portion of the curve being positioned to locate the top and base portions 56, 44 in the relationship illustrated in FIG. 6. Slight curve to each arcuate portion 46 gradually turns upward at an increasing rate at the ends thereof to provide increasing resistance to further rocking of the top portion relative to the base beyond a given range of movement.

A driving mechanism 60 may be provided, such as about the central side edges of bottom portion 44, to drive, for example, a magnet (not shown) on a rod 62 received within the drive mechanism 60, this magnet being linearly driven by the driving mechanism, first in one direction then in the other direction. Such drive mechanisms are in common use and well known as, for example, in window displays, and the like. They are simple in construction, inexpensive, and will operate for long periods without attention. The driving mechanism 60 may be powered by an appropriate source of electrical power (not shown) applied to the driving mechanism 60 through an electrical connection (not shown) or by means of batteries (also not shown).

Figures 7, 8, 9, 10, 11:
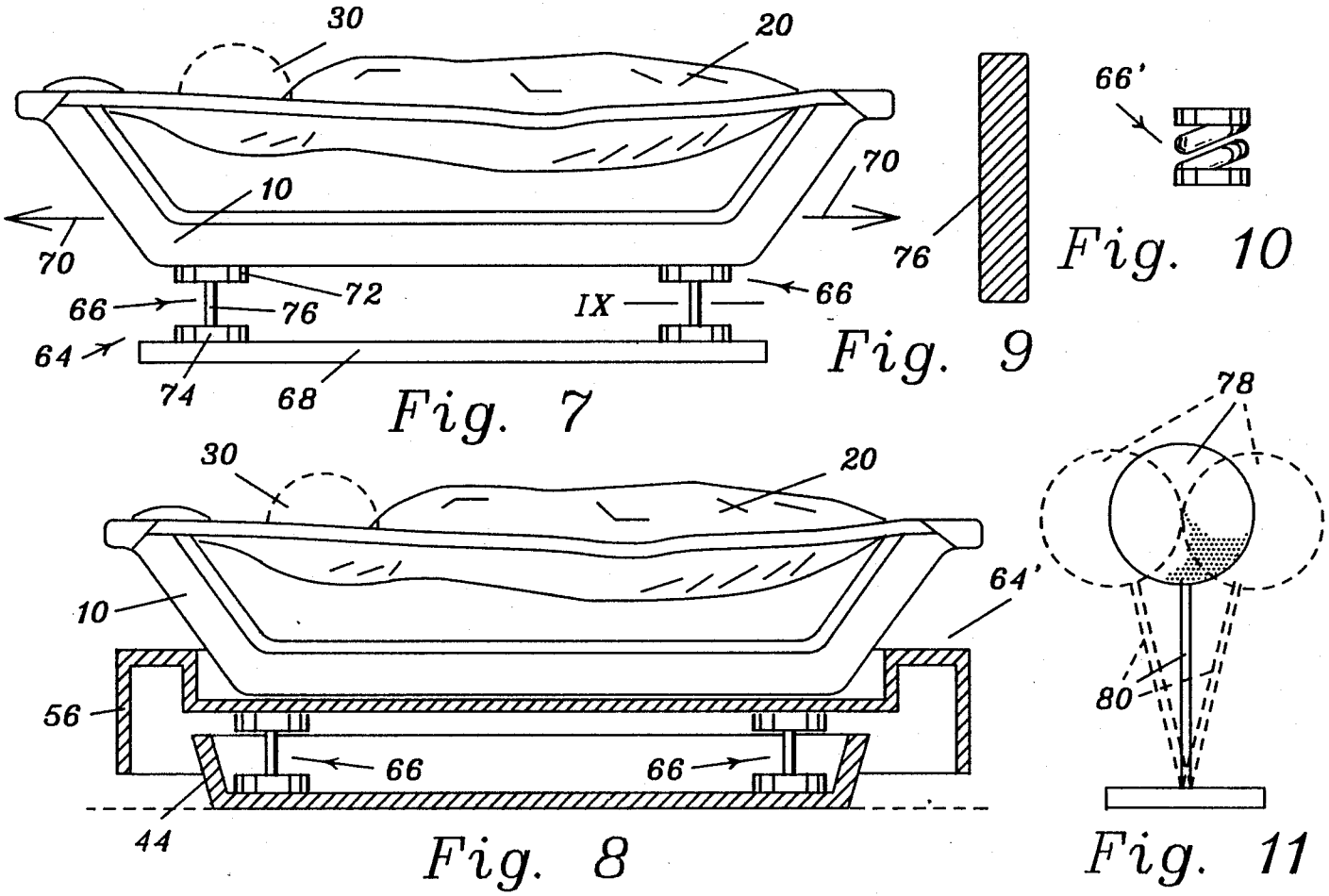
FIG. 7 is a side view of the present invention incorporating rocking-producing components according to a second and preferred embodiment thereof.
FIG. 8 is a side view of the present invention incorporating rocking-producing components according to a third embodiment thereof.
FIG. 9 is a cutaway view through one of the spring suspension units of the present invention in its preferred embodiment.
FIG. 10 is a side view of a possible alternate embodiment for the spring suspension units of the present invention.
FIG. 11 is a simplified drawing showing the manner of operation of the rocking mechanism of the present invention in its preferred embodiment.

The simplest, and therefore preferred, embodiment of the present invention for providing the necessary rocking motion is shown in FIG. 7 and requires no power except that provided by the movement of the infant itself. In this case, the rocking means, generally indicated as 64, is directly attached to the parallel base members 24 of the supporting structure 10. Rocking means 64 comprises four spring suspension units 66 placed, respectively, at the four corners of the supporting structure 10 adjacent the bottom surface of the parallel base members 12. If desired, an interconnecting base 68 (either solid or open-rectangular) can be attached to the bottom of the four spring suspension units 66 for resting on the bottom of the isolette, or the like, into which the infant hospital bed unit of the present invention is placed. The spring suspension units 66 are designed to have easy movement in the lateral direction as indicated by the arrows 70 while being resistive to compressive forces in order to resistance and eliminate undesired rapid bouncing and jiggling movements. If desired, the lateral movement may be further limited to longitudinal movement and made resistive to transverse movement as well in order to achieved only longitudinal back and forth movements in the head-to-toe direction. The spring constant of the spring suspension units are chosen to encourage slow horizontal motion which is induced from the normal movement of the infant 30. A configuration of the spring suspension units 66 which will achieve only slow motion in one horizontal direction is shown in cutaway view in FIG. 9. Each unit 66 comprises upper and lower connecting plates 72, 74, respectively, separated by planar leaf spring member 76. The upper connecting plates 72 can be used to attach the units 66 to the bottom of the base members 12 while the bottom connecting plates 74 can be used to attach the units 66 to the base 68 or, alternatively, sit directly upon a surface such as a mattress, or the like. By making the spring member 76 rectangular or circular in cross section instead of rectangular, horizontal movement in all directions is achieved. As can be seen from the cutaway view of FIG. 9 taken in conjunction with the side view of FIG. 7, the rocking means 64 in its preferred self-actuating embodiments acts in the manner of the simplified drawing of FIG. 11; that is, the infant 30 acts in the manner of large mass 78 disposed on top of an elongated vertically disposed spring member 80. This is an unstable situation and, therefore, the slightest movement of the infant 30 (i.e., the mass 78) puts the mass in motion until it is arrested by the spring potential of the spring suspension unit 66 (i.e. the spring member 80) urging it in the opposite direction. Thus, the infant 30 in combination with the rocking means 64 acts in the manner of a pendulum; and, since the mass is large with respect to the spring potential of the suspension unit, a long time period is achieved and, therefore, a gentle, slow rocking motion is obtained, as desired. Because of the shape of the spring member 76 (whether rectangular, square, or round), compressive forces which would result in bouncing and jiggling are eliminated. The rocking means 64 responds easily only to forces tending to produce the desired and preferred rocking motion in a horizontal plane. While not preferred, a helical spring type suspension unit such as that indicated as 66' in FIG. 10 could be employed. In this case, the spring constant and construction of the spring should be such as to encourage gentle horizontal movement while avoiding vertical bouncing and jiggling movement as described above.

An alternatively preferred embodiment is shown in FIG. 8 wherein a rockable base 40' such as that of FIG. 6 has the previously-described rocking components replaced by spring suspension units 66, as described above, disposed between the bottom portion 44 and the top portion 56 thereof.

Figure 5:
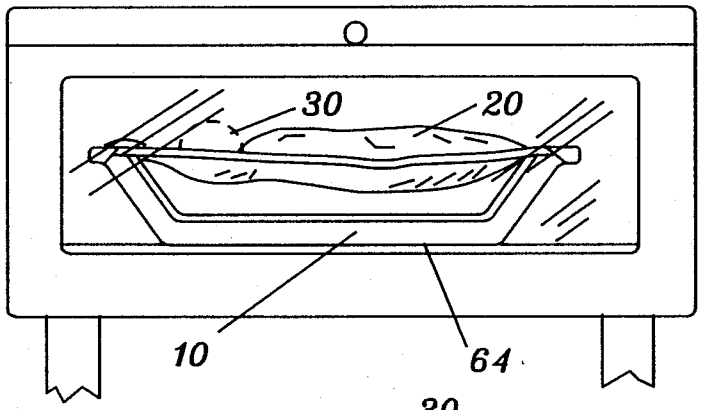
FIG. 5 is a drawing showing the components of FIGS. 3 and 4 disposed in an isolette with an infant therein.

As can be appreciated from the description hereinbefore, in any of its embodiments as described, the therapeutic infant bed of the present invention is easily placed inside of a conventional isolet, or the like, as shown in FIG. 5.

Wherefore, having thus described my invention, I claim:

1. A therapeutic infant bed for use in the treatment and prevention of infant apnea comprising:

(a) a hammock-forming sheet of material having one surface thereof being of a soft tactile material, said hammock-forming sheet of material including means for attaching a sonic device for generating audible sounds and mechanical vibrational impulses simulating a human heartbeat thereto and for causing said audible sounds and mechanical vibrational impulses to be transmitted through said sheet and said support structure to an infant disposed in the bed;

(b) a support structure having raised, spaced end members defining an open space therebetween;

(c) means connected between said support structure and said hammock-forming sheet of material for horizontally suspending said sheet of material with said one surface facing up between said end members within said open space and above a surface over which said support structure is positioned to form a hammock having spaced head and foot ends and spaced sides between which an infant can be placed; and, (d) rocking means operably attached to said support structure for supporting said support structure above a planar surface and for horizontally rocking said support structure, said rocking means comprising a plurality of spring suspension members disposed under said support structure, said spring suspension members including spring members configured and having a spring constant relative to the mass of an infant disposed in the bed to resist compression forces causing bouncing and jiggling and to easily respond to forces producing slow horizontal movement of the bed.

2. The therapeutic infant bed of claim 1 wherein:

said spring members are vertically disposed leaf springs positioned to resist lateral movement and permit easy movement only in the horizontal direction between said head and foot ends.

3. The therapeutic infant bed of claim 1 wherein:

said hammock-forming sheet of material comprises a composite sheet of material having an inner pile surface bonded to an outer reinforcing fabric adapted to resiliently relax and deform to form a deepened central area for receiving and cuddling an infant disposed therein.

4. The therapeutic infant bed of claim 3 wherein:

said outer reinforcing fabric is a nylon netting.

* * * * *